US006453838B1

(12) United States Patent
Mowell et al.

(10) Patent No.: US 6,453,838 B1
(45) Date of Patent: Sep. 24, 2002

(54) TURRET-LESS FLOATING PRODUCTION SHIP

(75) Inventors: Roger W. Mowell, Houston; William A. Hunter, Katy, both of TX (US)

(73) Assignee: Ocean Production Technology, LLC, Houston, TX (US)

( * ) Notice: Subject to any disclaimer, the term of this patent is extended or adjusted under 35 U.S.C. 154(b) by 0 days.

(21) Appl. No.: 09/693,264

(22) Filed: Oct. 20, 2000

(51) Int. Cl.[7] ..... B63B 21/00
(52) U.S. Cl. ..... 114/230.13; 114/293; 114/144 B
(58) Field of Search ..... 114/293, 144 B, 114/230.13; 441/4, 5

(56) References Cited

U.S. PATENT DOCUMENTS

| | | | | |
|---|---|---|---|---|
| 4,643,614 A | | 2/1987 | Laursen | 405/169 |
| 4,762,180 A | | 8/1988 | Wybro et al. | 166/350 |
| 5,007,482 A | | 4/1991 | Forsyth et al. | 166/345 |
| 5,678,503 A | * | 10/1997 | Poranski | 114/293 |
| 5,823,131 A | | 10/1998 | Boatman et al. | 114/230 |
| 5,937,780 A | * | 8/1999 | Etheridge et al. | 114/293 |
| 6,085,851 A | * | 7/2000 | Scott et al. | 114/293 |

OTHER PUBLICATIONS

Moreira, J.R.F., et al., "Drill Pipe Riser: An Innovative Deepwater Completion/Workover Technology," Deep Offshore Technology Conference, 1998.

Moreira, J.R.F., et al., "Development and Installation of the Drill Pipe Riser, an Innovative Deepwater Production and Completion/Workover Riser System," OTC Paper 10892, Offshore Technology Conference, Houston, Texas, May 3–6, 1999.

"Innovative Deepwater Drillpipe–Riser System," Subsea Engineering (Synopsis of OTC Paper 10892), Journal of Petroleum Technology, Aug. 1999.

* cited by examiner

*Primary Examiner*—Jesus D. Sotelo
(74) *Attorney, Agent, or Firm*—Locke Liddell & Sapp, LLP.

(57) ABSTRACT

The invention consists of a floating production vessel operating on the surface of the sea with two or more risers connected between equipment or wells on the sea floor and the vessel or its equipment at the surface. The risers are rigid, jointed pipe with rugged field proven drill-pipe type connections. The arrangement, spacing, and support of the risers at the vessel and on the sea floor is such that the vessel, riser supports, and upper ends of the risers may be rotated from a neutral heading up to about 90 degrees in either direction without the use of a swivel or turret at the surface or sub-sea, and without damage to the risers or reducing the spacing between the risers unacceptably.

33 Claims, 7 Drawing Sheets

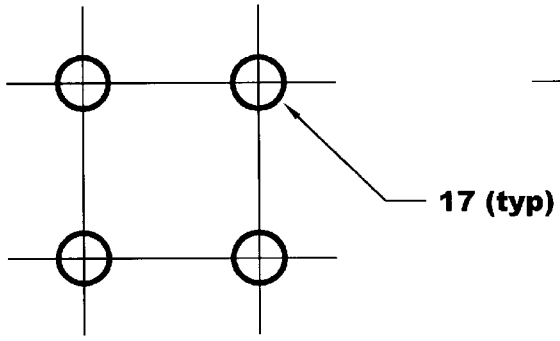
Fig. 4a
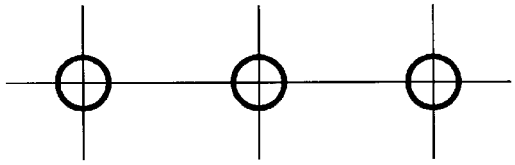
Fig. 4b
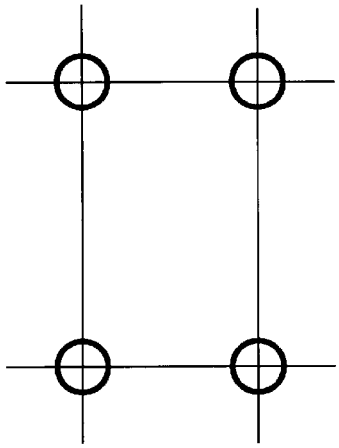
Fig. 4c
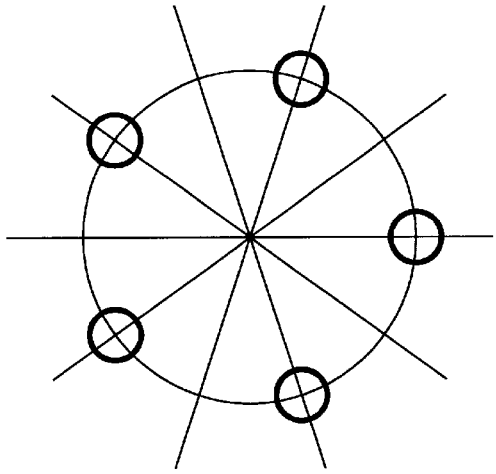
Fig. 4d
Fig. 4

TURRET-LESS FLOATING PRODUCTION SHIP

FIELD OF THE INVENTION

This invention generally relates to offshore oil and gas operations and more particularly to deep-water floating oil production, storage, and offloading operations.

BACKGROUND OF THE INVENTION

As oil and gas operations have moved further offshore into ever deeper water in search of new fields, fixed production platforms have continued to grow in height and expense. Fixed platforms have battered or sloped legs to provide stability, and the weight of steel required increases geometrically with water depth. Shell's Bullwinkle Platform in about 1400 feet of water was perhaps the deepest conventional platform ever installed. In deeper water, however, the use of bottom-founded steel or concrete structures for oil well drilling and production operations becomes quite expensive due to the high cost of fabrication and installation of such large structures.

As such, it has become more or less common practice to employ floating production structures in developments of oil and gas fields in deeper water offshore. These facilities may take one of several familiar offshore hull forms, for example semi-submersibles, spar-buoys, tension leg platforms, barges, or ships. All of these hull forms are moored, displacement buoyed vessels, and all respond to forces of wind, waves, and current. Because the wells and moorings are fixed at the sea floor, dealing with the motions of the production facility on the water's surface is at the heart of deepwater production system design.

Ships are the preferred floating production structure in that they are very efficient in terms of cargo and load carrying capacity. Although they are perhaps the most responsive floating production facility type to environmental forces in terms of motions, they have reasonable motion characteristics when headed into the weather and seas. Conversely, ships exhibit relatively poor motions in quartering or beam seas.

When ships are employed in floating production service where the weather and seas are mild and directional, such as offshore West Africa, they are often simply spread moored with flexible risers suspended over the side of the ship, like Exxon Mobil's Zafiro Producer. In most other areas of the world, though, the ship must be allowed to rotate or "weathervane" in order to keep the vessel headed into the weather or seas to reduce station-keeping loads and motions to acceptable levels. Weathervaning may be passive, or the vessel may be equipped to allow the operator to select a heading for the vessel. The latter feature is important where environmental forces are not co-linear, for example, where the wind forces and sea forces are at an angle to each other.

During weathervaning, the ship or vessel must be free to rotate while the moorings and production risers are fixed; i.e., not free to rotate with the vessel, and yet connected to the process system on the vessel. The ability to maintain this connection and yet weathervane is generally accomplished by means of swivels and one of several types of turntables, turrets, or turret transfer systems. The upper end of the vessel mooring cables and risers are connected to the turret, and the lower ends are connected to equipment at the sea floor, so the horizontal orientation of the turret is relatively fixed. The ship is allowed to rotate or weathervane around the turret.

The turret may be fitted in a vertical well through the ship's hull or it may be connected to the ship by means of an articulating yoke, usually at the bow. The turret may contain anti-friction or plain bearings, but in either case the bearings are required to translate the mooring forces into the hull. Turret rotation with respect to the ship may be active or passive. Propeller thrusters fitted to the ship that essentially rotate the ship around the turret accomplish active vessel rotation. Passive weathervaning involves placing the turret forward of midship and simply allowing environmental forces to rotate the vessel into a heading that minimizes mooring forces.

The well fluids, controls, and mooring loads must be transferred from the turret to the ship. The fluid transfer is accomplished by means of a multi-path high-pressure swivel or less frequently by means of a "drag-chain" carousel-type hose support structure and flexible hoses. The hoses are reeled off of or onto the carousel structure as the vessel rotates around the turret. The latter limits rotation to about 270 degrees in either direction, and so rotation of the ship around the turret must be of the active type. The turret, turret well, bearings, and fluid transfer system are very costly, in some cases about $70 million. Some turret systems are even more expensive because they are designed to be disconnected from the ship under certain circumstances, for example, when icebergs or cyclonic storms may be a problem.

A floating production mooring system in deep-water usually consists of twelve mooring legs, each consisting of two or more miles of between 4 and 6-inch diameter line of chain and wire combination. As is known in the art, the length of each mooring leg or line may be about 2 ½ to about 3 ½times the water depth. Installation of these mooring lines therefore requires the operational services of another seagoing vessel, such as a working barge or service vessel, which is used to carry the heavy lines from a port to the offshore well site for anchoring. Because of the size and weight of the mooring lines, multiple trips are needed by the working barge and its crew to secure the floating production ship to the sea bed, often over the course of a month or longer. Consequently, such a system is very costly to purchase and install, perhaps $30 million in 5000 feet of water. In addition, because the motions of the ship are translated into the riser system, floating production ships generally employ flexible pipe riser systems connected to subsea trees. The sophisticated flexible pipe risers used today in deep water can cost several million dollars per riser, and as much again for installation.

Accordingly, there is a need for a floating production ship that can quickly become operational and which avoids costly turret systems and mooring legs, uses rigid steel drill pipe risers, and is able to weathervane through at least 90 degrees in either direction, thus allowing the vessel to present a fair form to environmental forces from any direction.

SUMMARY OF THE INVENTION

The present invention is directed to a floating production vessel operating on the surface of the sea with two or more risers connected between equipment or wells on the sea floor and the vessel or its equipment at the surface. The risers are rigid, jointed pipe with rugged field proven drill-pipe type connections. The arrangement, spacing, and support of the risers at the vessel and on the sea floor is such that the vessel, riser supports, and upper ends of the risers may be rotated from a neutral heading up to about 90 degrees in either direction without the use of a swivel or turret at the surface or subsea, and without damage to the risers or without reducing the spacing between the risers unacceptably.

The foregoing has outlined rather broadly the features and technical advantages of the present invention so that the detailed description of the invention that follows may be better understood. Additional features and advantages of the invention will be described hereinafter which form the subject of the invention. It should be appreciated by those skilled in the art that the conception and the specific embodiments disclosed may be readily used as a basis for modifying or designing other floating production ships for carrying out the same purposes of the present invention. It should also be realized by those skilled in the art that such equivalent constructions do not depart from the spirit and scope of the invention as set forth herein.

BRIEF DESCRIPTION OF THE DRAWINGS

The accompanying drawings, which are incorporated in and form a part of the specification, illustrate the embodiments of the present invention, and, together with the description, explain the principles of the invention. In the drawings:

FIG. 4 is a plan view of different risers arrays of the present invention showing a square array (4A), a linear array (4B), a rectangular array (4C), and a polar array (4D);

It is to be noted that the drawings illustrate only typical embodiments of the invention and are therefore not to be considered limiting of its scope, for the invention will admit to other equally effective embodiments.

DETAILED DESCRIPTION OF THE INVENTION

As a general overview, the instant invention describes a shipshape floating production system with multiple risers that has the ability to weathervane through 180 degrees, i.e., 90 degrees either side of a neutral heading and effectively point either the bow or stern into the weather from any direction but which requires no turret, swivel, or "drag chain," and, in the preferred embodiment, no mooring system. The risers are rigid, jointed pipe with rugged field proven drill-pipe type connections. The risers may be installed by the production ship itself rather than by a separate sub-sea construction vessel. Installation requires a matter of days rather than months in the conventional case, and costs a few million dollars rather than tens of millions.

Figure 1:
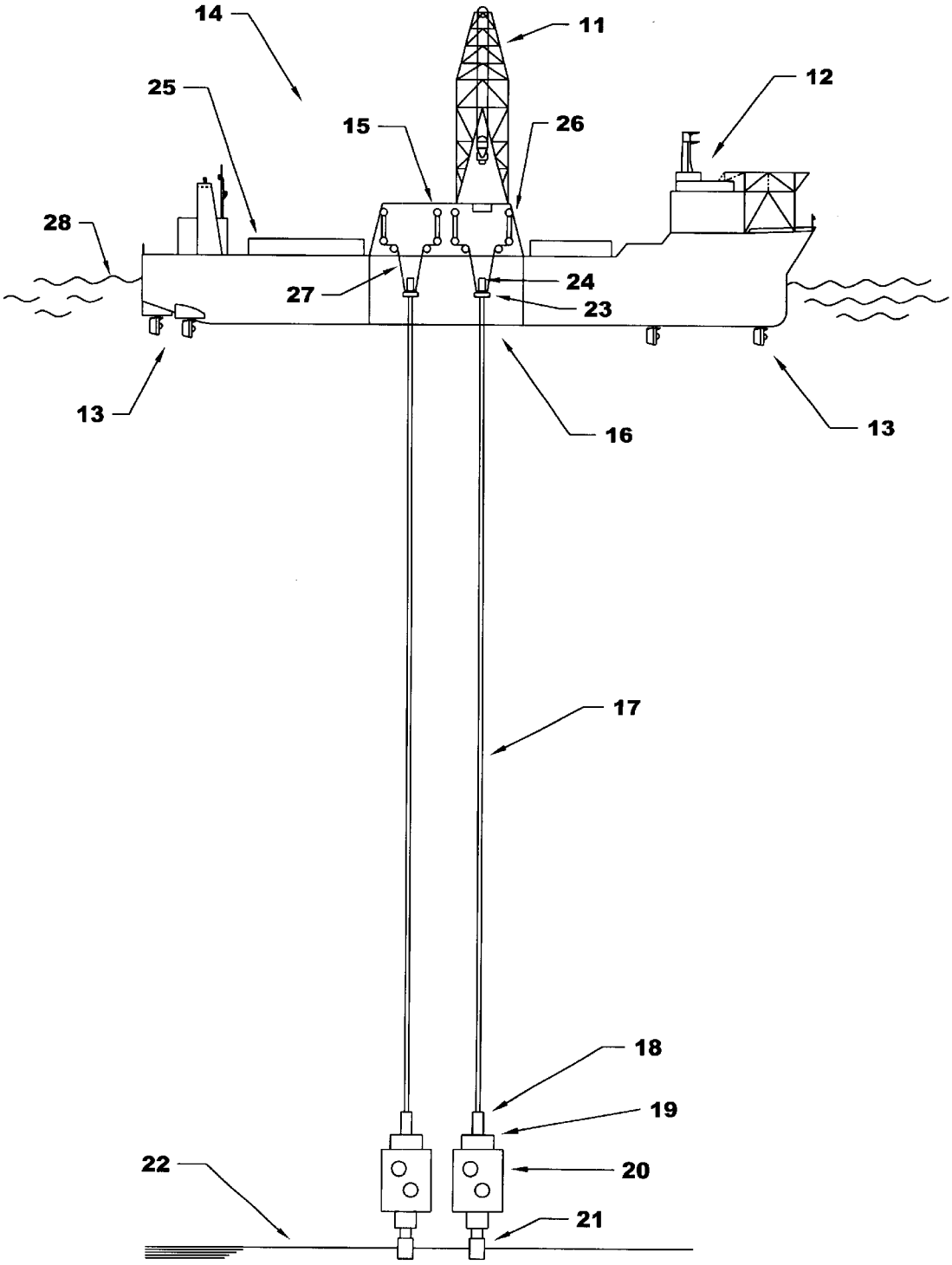
FIG. 1 is an elevation view of an embodiment of the present invention showing a turret-less floating production ship without a mooring system.

Turning now to FIG. 1, there is shown the general arrangement of a preferred embodiment of the invention, that is, a turret-less floating production ship 14 without a mooring system. The ship 14 operates on the surface of a body of water 28 with two or more risers 17 in fluid connection with equipment or wells. on a sea floor 22. As it is understood to those skilled in the art, that while a ship-shaped vessel is shown such as an oil tanker converted to an oil production facility, other floating production vessels such as barges, semi-submersible hulls, catamarans, and the like may be employed. Although not shown, the ship 14 has a reasonably fair stern; ideally a stern shaped somewhat like the bow, and known in the art as a "double-ender." The ship 14 is preferably a double hull, double bottom tanker and is equipped with a quarters house 12, a substructure 15, process equipment 25, and a moon pool 16 within the ship's hull. The ship 14 may have space and equipment 25 to process the produced oil, gas, and water and, if desired, one or more oil storage compartments within the hull. The ship 14 is dynamically positioned by means of thrusters 13 controlled by computers and a reference system. Such thruster systems could include azimuthable propellers and are well known in the art.

The substructure 15 supports a movable derrick 11 with its hoisting gear. While any derrick of desired construction and height may be used (even including other hoisting means such as a movable crane, block and tackle system, hydraulic system, and the like), the preferred embodiment uses a standard marine floating derrick that is about 165 feet tall. As discussed in more detail below, the derrick 11 is free to skid between the various riser locations on the substructure 15. In addition to supporting the derrick 11, the substructure 15 also houses riser tensioning gear 26 for maintaining tension on the risers 17 within the moon pool 16 as the vessel moves in response to the sea.

The risers 17 are similar in construction to drill pipe; jointed and rigid steel with threaded, screwed, or other quick make and break coupling joints. Drill pipe may in fact be, and is employed in this service. Although any length of pipe section may be used in the present invention, the preferred lengths are Range 2 pipe of roughly 30 feet in length or Range 3 pipe of roughly 40 feet in length. Each riser 17 or drill pipe section is stored on a pipe rack and deployed and retrieved using the drilling type derrick 11 and drawworks. Motion compensation is required, and is provided by the riser tensioners or, while the risers are suspended on the derrick hook, by means of bumper subs. Bumper subs are axially extendable, spring loaded, pipe within pipe with suitable seals which are well known in the art, and were widely employed in floating drilling prior to the advent of motion compensators. While rigid steel pipes are preferred due to their cost and reliability, the present invention will admit to the use of flexible production risers, with or without flotation means positioned along the length of the flexible riser. Moreover, hybrid risers that may consist of a single pipe or a vertical bundle of steel pipes and perhaps surrounded by some type of buoyancy composite material or thermal insulation over at least part of its height may be used. As discussed below, riser tension may be provided by buoyancy elements at or near the surface of the water.

The risers 17 are flexibly supported on a riser yoke 23 by the riser tensioners 26 and riser tensioning cables 27. From about four to about six riser tensioners 26 are used for each riser 17 to allow for redundancy. Because the risers 17 are commonly steel pipe and are fixed at their lower end, they must be supported at their upper ends with automatic heave compensating equipment so that vertical vessel motions (heave) produced by wave action or tidal effects are not imposed on the production risers. Depending upon the roughness of the seas, the riser tensioners 26 are generally designed to allow for plus or minus 25 feet of heave of the ship, that is, to cover a range of about 50 feet in the up or down motion of the ship. The risers 17 are equipped with a surface flow tree 24, which contains failsafe valves to shut in the riser, and is connected to the process equipment 25 via a flexible hose (which also has a failsafe valve), not shown.

The risers 17 extend through the moon pool 16 with near vertical departure to the sea floor 22. At the lower end of the risers 17 is a stress joint 18 and lower marine riser package 19. The stress joint 18 transmits the bending moment from the riser 17 into a subsea tree 20 and thence into a wellhead 21 which in turn is connected to a well extending to a subsea hydrocarbon containing formation. The lower marine riser package 19 generally consists of well and riser controls, valves to shut in the riser, and a connector to interface to the top of the tree 20. If it is necessary to disconnect the riser 17 from the tree 20, the well is automatically shut in and the riser valves closed to secure the riser 17 prior to release of the connector. This is accomplished by a failsafe hydraulic or multiplex control system that is familiar in the art.

More specifically, when a dynamically positioned vessel is connected to a hydrocarbon reservoir, it is necessary to provide for the possibility of station-keeping failure of the vessel. This is accomplished by providing an emergency disconnect package on the vertical flow path subsea tree which allows the well to be quickly secured, shuts in the riser, and then allows the riser to be disconnected from the main subsea tree. Such subsea trees are familiar in the art, having been used in the North Sea for many years. These trees have evolved over the years and are more fully described in OTC paper 10892 published in May 1999.

Figure 2:
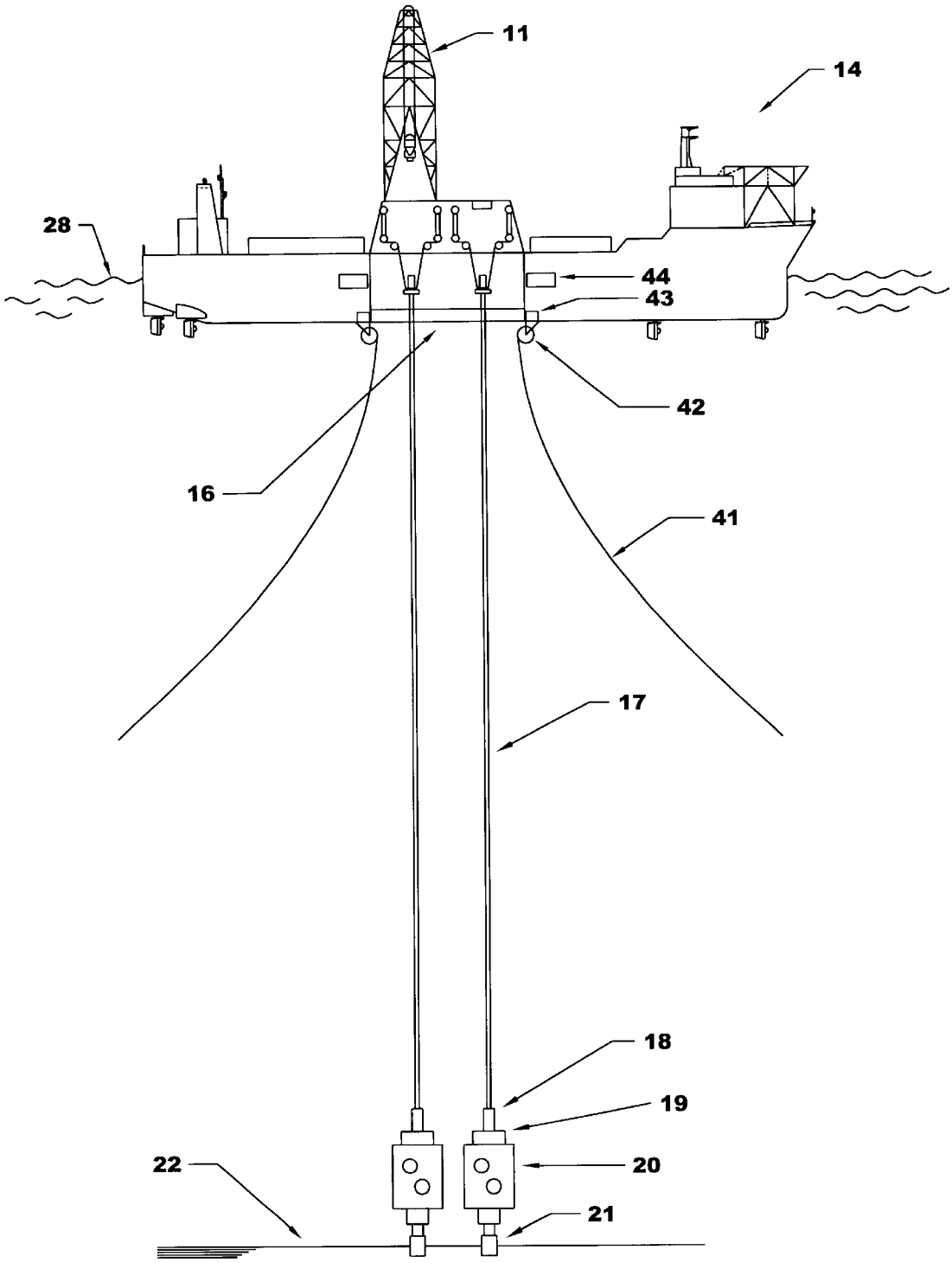
FIG. 2 is an elevation view of another embodiment of the present invention showing a floating production ship with a mooring system around the moon pool.

Turning now to FIG. 2, there is shown an alternative embodiment of the present invention where the floating production ship 14 is fitted with mooring gear arrayed around the moonpool 16. Depending upon the conditions of the sea, the ship may be moored with a spread catenary mooring system or any other conventional mooring system known in the art. As shown here, the mooring gear on the ship 14 consists essentially of several thousand feet of mooring line 41, a windlass or winch 44 with redundant braking systems for deploying, tensioning, and retrieving the mooring line 41, swiveling fairleads 42 which project below the hull for directing the mooring lines, line swivels to prevent kinks in the mooring chains, chain stoppers 43, and anchors for providing holding power to keep the vessel moored on station. For each mooring point of a vessel, separate mooring gear is required. The arrangement of the mooring lines in FIG. 2 is similar to the mooring arrangement around a turret. If the fairleads 42 are arranged around the moon pool 16, then the ship 14 may be rotated about the moorings by about 90 degrees in either direction using thrusters 13. The mooring lines 41 could be made of chain, wire, synthetic rope, or any combination thereof, secured to an anchoring means on the sea floor 22 such as a drag-embedded anchor, suction pile anchor, or anchor piling driven or drilled and grouted into the sea floor 22. Depending upon the size and displacement of the ship, the prevailing sea conditions, and the length of time the ship will be expected to remain on station, from about four mooring lines to about eight to twelve mooring lines may be used to secure the ship, with mooring assist by vessel thrusters if desired.

Figure 3:
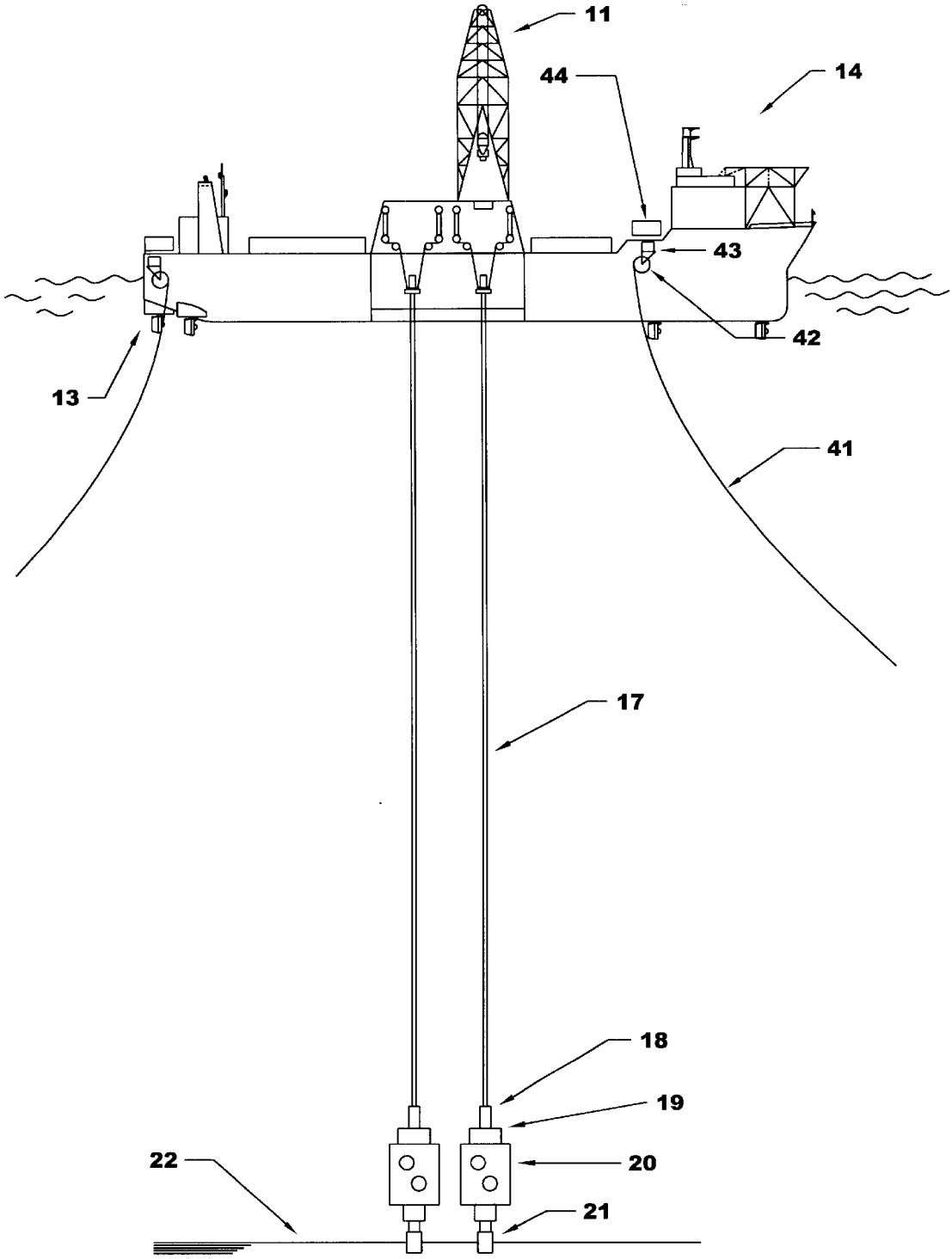
FIG. 3 is an elevation view of another embodiment of the present invention showing a floating production ship with a mooring system at the bow and stem.

FIG. 3 shows yet another alternative of the present invention where the floating production ship 14 is moored at the stem and stern of the ship. Specifically, the moorings may be arranged with swiveling fairleads 42 at the stem and stern, and by means of slacking certain lines 41 and tensioning others 41, by means of winches or windlasses 44, the vessel may be rotated though several points of the compass. No matter how the vessel is moored, each mooring system for large vessels may cost in the millions of dollars. For vessels having eight or more mooring systems, the mooring system may cost in the tens of millions of dollars.

One of the major issues defining the arrangement of multiple deep-water risers is spacing between the risers. The risers behave as a tensioned wire, and when excited by motion of the vessel, wave impact, and/or vortex shedding, oscillate in various modes. Clashing between the risers must be minimized to eliminate metal fatigue and is mitigated by maintaining minimum spacing between risers and riser tension adjustment.

Figure 5:
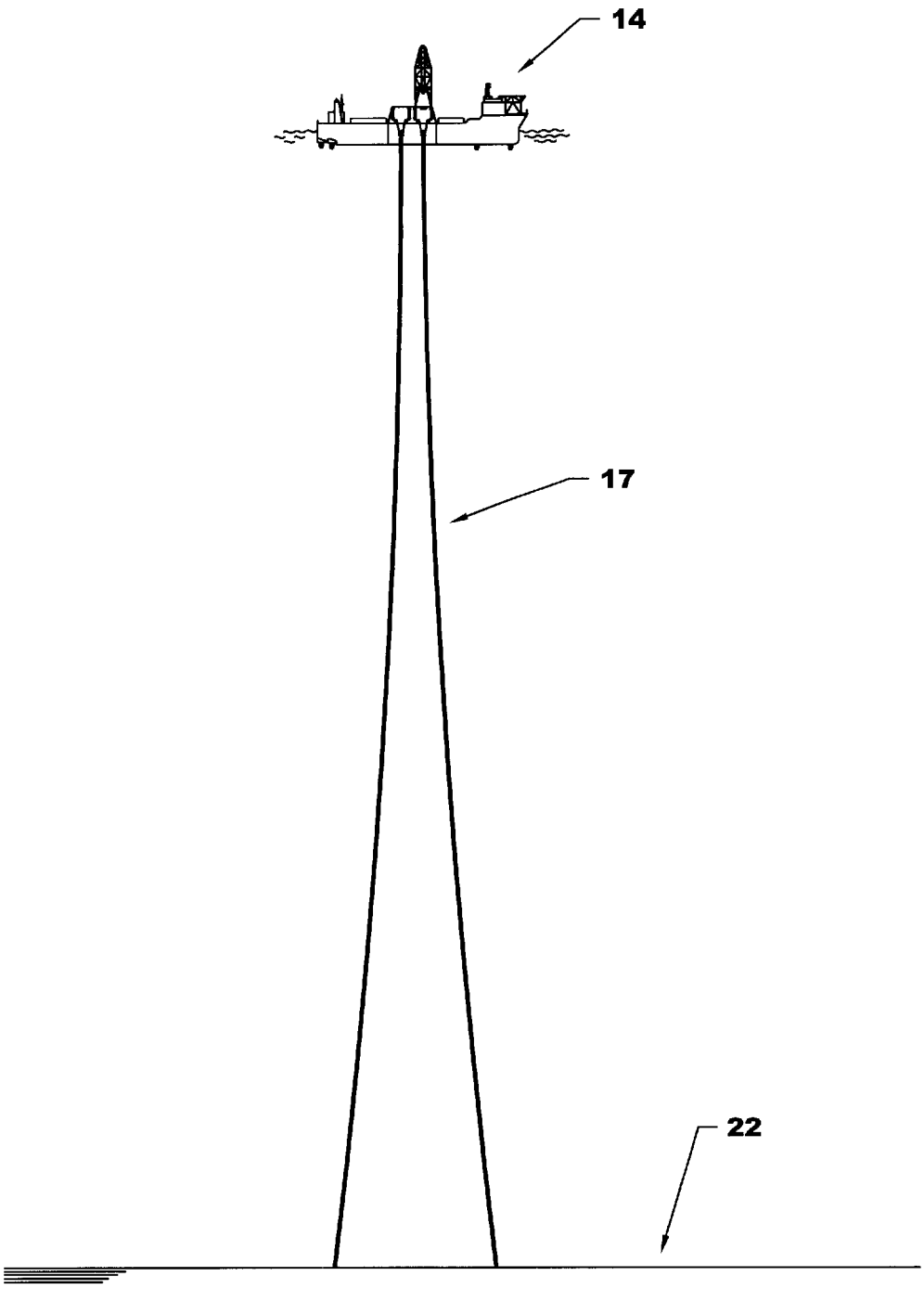
FIG. 5 is an elevation view of an embodiment of a floating production ship of the present invention showing the divergence in the risers from the ocean surface to the sea bed.

The risers 17 in the preferred embodiment are arranged at the surface of the ocean 28, i.e. within the substructure 15 and moon pool 16, in an array, which may be linear, rectangular, or polar, of suitable dimension. Some possible arrays are shown in plan view in FIG. 4. FIG. 4A shows a square array of riser locations. FIG. 4B shows a linear arrangement of three risers. FIG. 4C shows a rectangular array and FIG. 4D a polar array. The special arrangement of the risers 17 at the sea floor 22 should be similar to that at the vessel 14, but spacing at the sea floor 22 may be larger than that at the surface 28, such that the risers 17 diverge as they descend, which increases spacing between risers 17. This divergence, exaggerated for clarity, is shown in FIG. 5.

In one embodiment of the invention, the risers are arranged in a square array of four, and adjacent risers are separated by a distance "d" at the surface and at the sea floor. The ship can rotate around the center of the riser array in either direction up to at least 90 degrees with a reduction in riser separation decreasing as a function of one-half the cosine of the angle of rotation until at 90 degrees the static riser spacing of the risers at the closest point (the mid point) will be about 0.707d. Since the ship's stern is fair, the ship will exhibit similar motion characteristics from bow and stem, effectively allowing the vessel to handle weather from any point on the compass without a turret, swivel, or other turret transfer system.

Alternatively, when it is not convenient to cluster the wells in a proximate array, the wells may be widely spaced on the sea floor and tied back to a manifold to which in turn the risers may be later attached. Such an arrangement, where flexible piping is laid on the sea floor as flowlines to connect individual subsea wells to a centrally located sea floor manifold, is familiar in the art. The manifold may simply act as a base for the risers with access to the individual well flowlines, or it may be equipped with chokes and valves for commingling production flow, handling water and or gas injection flow, export pipelines connection and artificial lift distribution requirements. The manifold is equipped with the same quantity of vertical hubs as exists on the production vessel, and the risers disconnectably connected to the manifold vertical hubs. Control lines may be run down one or more of the risers, and distributed at the manifold.

Figure 6:
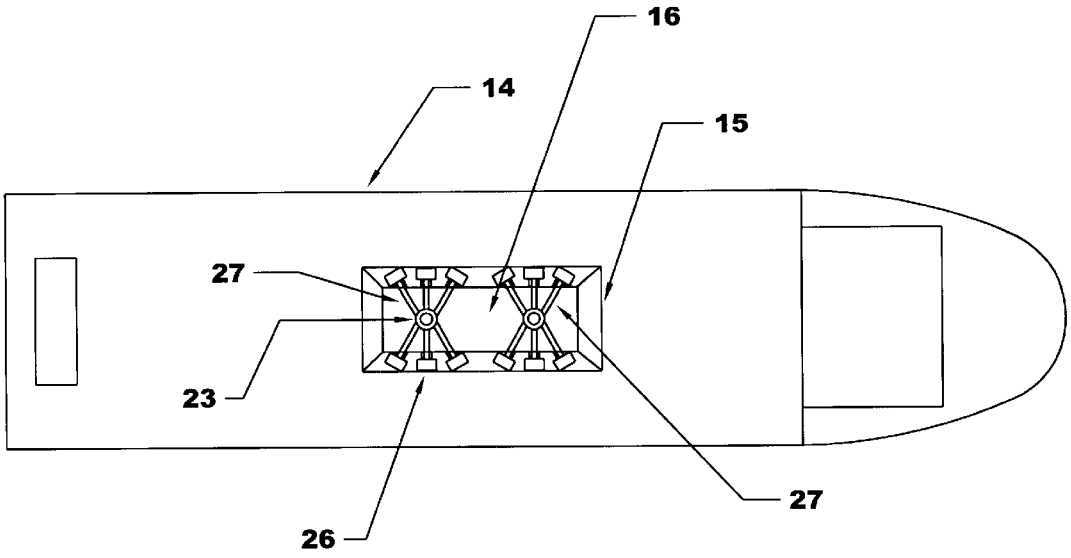
FIG. 6 is a plan view of a derrick skid, riser bays, and riser tensioners of the present invention.

Because the risers may be arranged in a variety of array patterns, the derrick must be able to move from one riser location to another, or alternative means must be provided for transferring the riser load from the derrick hook to the riser tensioners, such as a gantry crane over the moonpool or handshaking of rope slings between the hook and riser tensioners. FIG. 6 shows one such embodiment of a skid-mounted movable derrick. The derrick is mounted above the riser bay and may be skidded in the longitudinal and/or transverse direction such that the hook or lifting point on the derrick may be suspended over each of the riser's vertical centerlines. For example, in a two-riser system as shown in FIG. 1, or in any linear array, the derrick can move along the x-axis of a simple skid rail to each riser location—here, the derrick is in the forward well position in FIG. 1 and the aft position in FIG. 2. In a nonlinear riser array, the skid can move along the x-axis and y-axis of the skid base to each riser location. In any event, the skid system used, or other system used to move the derrick, allows the derrick to access all of the risers.

One set of riser tensioning equipment is located over the centerline of each of the risers, at the upper end of each riser in the array. From about four to about six riser tensioners are used for each riser to allow for redundancy. Depending upon the desired arrangement, the riser tensioning equipment may be arranged parallel or perpendicular to the longest length of the ship. Normally the riser tensioning equipment is not movable. The risers may be tensioned by pneumatic over hydraulic means, or by buoyancy elements, or by other means known in the art. Whatever method is used, it can be seen that despite a relatively rigid connection of the production riser to the floating production vessel, vessel motions such as heave (up and down), surge (forward and back), and sway (side to side), or any combination of these motions, is fully compensated for by the riser tensioners.

Figure 7:
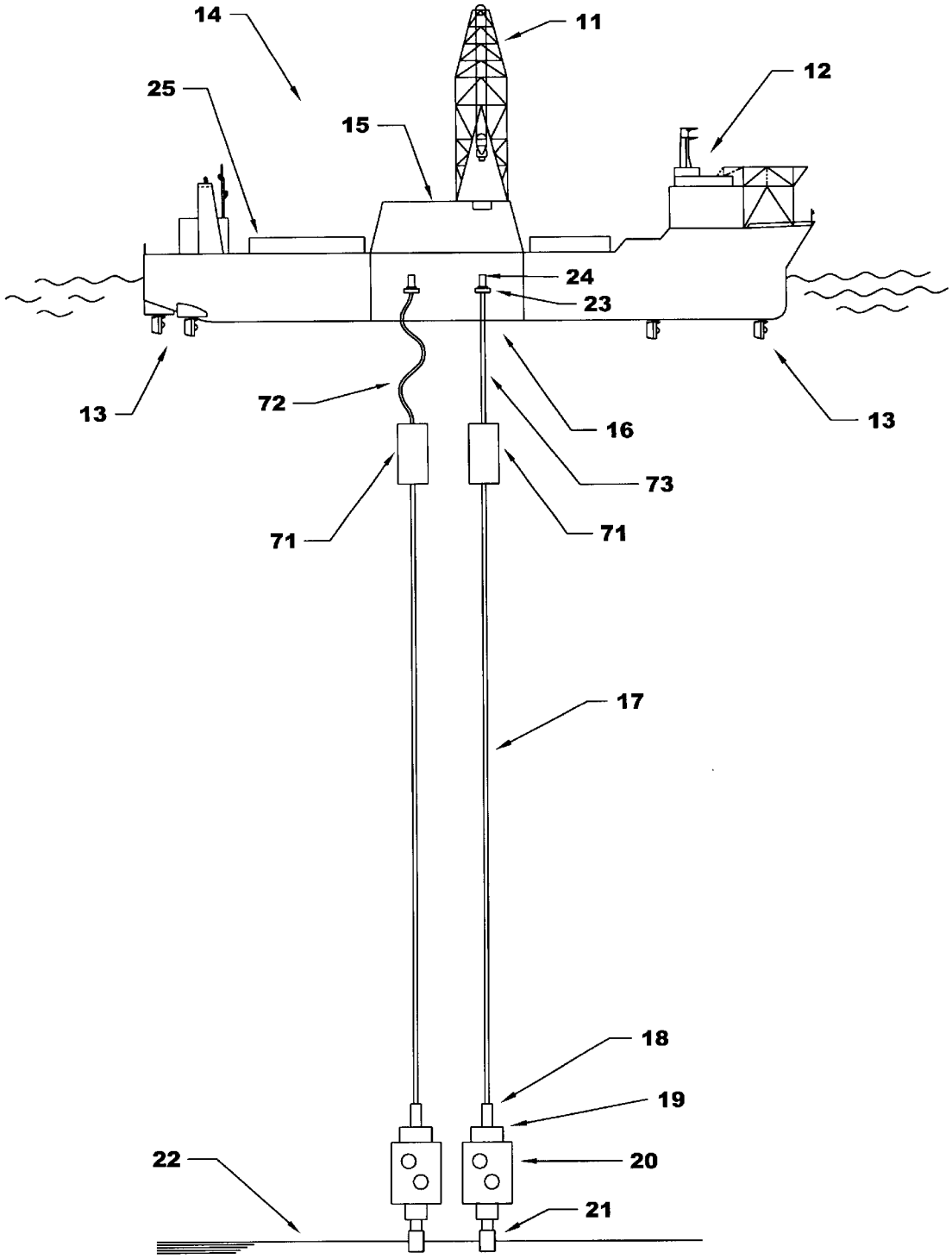
FIG. 7 is an elevation view of an embodiment of a floating production ship of the present invention wherein the risers are tensioned by means of buoyancy elements below the water line and connected to the production ship with both flexible and rigid riser jumpers between the riser at the buoyancy element and the jumper support in the moon pool.

Turning now to FIG. 7, there is shown yet another embodiment of a floating production ship wherein the risers 17 are tensioned by means of buoyancy elements 71 below the water line and connected to the production ship with both flexible 72 and rigid 73 riser jumpers between the riser at the buoyancy element and the jumper support in the moon pool. The buoyancy elements 71 may be of any construction known in the art, such as multi-chambered steel cans filled with air, and are typically placed at a depth from about 50 feet to about 100 feet below the water line. In general, the depth chosen is such that the buoyancy elements are below the influence of the surface movements of the water. Moreover, while FIG. 7 shows a flexible riser jumper 72 and a rigid riser jumper 73, the jumpers used with the present invention could be all flexible, or all rigid, or any combination thereof.

In practice, the offshore wells to be produced by the system are usually drilled and completed using a suitable mobile offshore drilling unit. The wells may-be arranged in an array similar to that at the vessel by means of a spacer template, or simply arrayed on the seafloor without use of a template. The well spacing at the seafloor may be slightly more than that at the surface, so that the risers diverge as they descend, further reducing the problem of risers clashing.

In this case, once the wells have been drilled, completed, and secured, the novel production vessel is stationed above the wells. While the present application describes a double-ended ship, those skilled in the art can appreciate that other vessel constructions such as barges or catamarans may be used. In any event, the derrick on the vessel is skidded over the first riser location and a vertical flow path subsea tree is run on a drill pipe or similar jointed, tubular riser using the derrick. A control umbilical may be strapped to the riser pipe using special clamps or saddles and banding. The umbilical has electric cables and hydraulic power to remotely control the subsea trees and valves. The type of riser employed is well known in the art, and is further described in an article in the Journal of Petroleum Technology in Aug. 1999. The riser is spaced out, terminated with a flex joint and surface flow tree, and the flex joint is hung off on a riser support guide in the moon pool. The surface flow tree is connected to the vessel's process plant by means of a flexible hose. Each riser has a riser support guide, similar in construction and appearance to a drilling derrick block dolly, which transfers the riser tension from the tensioners to the riser, and keeps each riser flex joint centralized in its designated vertical position.

Although the present invention and its advantages have been described in detail, it should be understood that various changes, substitutions, and alterations could be made herein without departing from the spirit and scope of the invention as defined by the appended claims.

What is claimed is:

1. An apparatus for conducting floating oil and gas production operations offshore comprising:

a turret-less vessel equipped with multiple risers arranged so that the vessel may rotate up to at least 90 degrees in either direction around the risers without damage to the risers;

the risers extending between the vessel and subsurface equipment; and at least one flex joint for each riser being included to absorb the bending moment on the riser during rotation of the vessel.

2. The apparatus as in claim 1, wherein the vessel is a ship with a fair stem.

3. The apparatus as in claim 1, wherein the vessel is a semisubmersible vessel.

4. The apparatus as in claim 1, wherein the risers are tensioned with pneumatic/hydraulic riser tensioning cylinders.

5. The apparatus as in claim 1, wherein the risers are tensioned with buoyancy cans or floatation elements.

6. The apparatus as in claim 1, wherein the risers are rigidly supported from the vessel.

7. The apparatus as in claim 1, further comprising:

a drilling-type derrick mounted upon the vessel; and means for moving the derrick over each riser.

8. An apparatus for conducting floating oil and gas production operations offshore comprising:

a vessel equipped with a moonpool and at least two risers arranged in an array without a turret within the moonpool so that the vessel may rotate up to at least 90 degrees in either direction around the riser array without damage to the risers; and means for maintaining the risers in tension.

9. The apparatus as in claim 8, wherein the vessel is a ship with a fair stern.

10. The apparatus as in claim 8, wherein the vessel is a semisubmersible vessel.

11. The apparatus as in claim 8, wherein the risers are tensioned by pneumatic/hydraulic means.

12. The apparatus as in claim 8, wherein the risers are tensioned by means of buoyancy elements.

13. The apparatus as in claim 8, further comprising:

means for mooring the vessel, said means comprising conventional moorings which originate around the moon pool.

14. The apparatus as in claim 8, further comprising:

means for mooring the vessel, said means comprising conventional moorings which originate from the bow and stern.

15. The apparatus as in claim 8, further comprising:

means for dynamically positioning the vessel, said means comprising thrusters.

16. A method for producing oil and gas fields offshore comprising the steps of:

employing a floating vessel;

connecting multiple, ridge risers between the vessel and subsurface equipment for production, injection, or re-injection wherein the risers are disconnectable from subsea wells with both risers and wells being quickly secured prior to such disconnection; and weathervaning the floating riser without the use of a turret, by causing the rigid risers to bend without damage and without reducing the spacing between the risers unacceptably.

17. The method as in claim 16, wherein the vessel can store the hydrocarbon products on board for discharge to another vessel.

18. The method as in claim 16, wherein the rigid production risers are connected to a manifold which manifold may be connected to production or injection wells, gas lift, electrical, control, or product export lines.

19. The method as in claim 16, wherein the rigid production risers are connected to flow line bases that are fixed to the sea floor.

20. The method as in claim 16, wherein the vessel is lightly moored with mooring assist by means of vessel-mounted thrusters.

21. The method as in claim 16, wherein the vessel is moored and weathervaning is by means of thrusters.

22. A system for the production of hydrocarbon fluids from a subsea formation without the use of a turret comprising:

at least one well head located at the floor of the sea, said well head having a riser connection;

a vessel located at the surface of the sea; and at least two production risers extending between the well head riser connector and the vessel, the risers being disposed in an array so that the vessel may rotate up to at least 90 degrees in either direction around the riser array without damage to the risers and being interconnected at the vessel and at the well head in a manner to accommodate bending moments impose on the risers by rotation of the vessel.

23. The system as in claim 22 further comprising:

means for mooring the vessel.

24. The system of claim 22, further including means for tensioning the risers.

25. A system for transporting petroleum products from deep water formations, including subsurface equipment and a floating vessel at the sea's surface; the improvement comprising:

at least a plurality of risers, at least one of which is a relatively rigid riser connected between the subsurface equipment and the vessel;

means for suitably and appropriately spacing the plurality of risers, so that the floating vessel may weathervane and cause the risers to bend relative to each other without damage to the risers or without reducing the spacing between the risers unacceptably; and the system being free of any turret for the risers.

26. The system of claim 25 and further including means for maintaining the risers in tension.

27. The system of claim 26 and wherein the risers are comprised of relatively rigid, jointed pipe.

28. The system of claim 27 wherever the system further includes at least mooring line.

29. The system of claim 26 wherein four risers are included and are in a rectangular array.

30. The system of claim 26 wherein at least three risers are included and are in a linear array.

31. The system of claim 26 and wherein at least three risers are included and are in a polar array.

32. The system of claim 26 wherein the means for maintaining the rigid risers in tension comprise tensioning means on the floating vessel.

33. The system of claim 26 wherein the means for maintaining the rigid risers in tension includes buoyancy elements connected to the risers.

* * * * *

UNITED STATES PATENT AND TRADEMARK OFFICE

CERTIFICATE OF CORRECTION

PATENT NO. : 6,453,838 B1
DATED : September 24, 2002
INVENTOR(S) : Mowell et al.

It is certified that error appears in the above-identified patent and that said Letters Patent is hereby corrected as shown below:

Column 3,
Line 30, please delete “stem” and insert therefor -- stern --.

Column 6,
Line 39, please delete “stem” and insert therefor -- stern --.

Column 7,
Line 44, please delete “may-be” and insert therefor -- may be --.

Column 8,
Line 25, please delete “stem” and insert therefor -- stern --.

Signed and Sealed this

Fourth Day of February, 2003

JAMES E. ROGAN
*Director of the United States Patent and Trademark Office*